US005568009A

United States Patent [19]

Gandhi

[11] Patent Number: 5,568,009

[45] Date of Patent: Oct. 22, 1996

[54] ELECTRIC LAMP HAVING A LAMP CAP WITH SOLDER-FREE CONNECTIONS

[75] Inventor: Harish Gandhi, Morgantown, W. Va.

[73] Assignee: Philips Electronics North America Corporation, New York, N.Y.

[21] Appl. No.: 366,135

[22] Filed: Dec. 29, 1994

[51] Int. Cl.[6] ..... H01J 5/48

[52] U.S. Cl. ..... 313/318.01; 313/318.03; 313/318.09; 313/318.12; 439/613; 439/615

[58] Field of Search ..... 313/318.1, 318.03, 313/318.04, 318.09, 318.10, 318.11, 318.12; 439/613, 615, 617, 640, 641, 642, 751

[56] References Cited

U.S. PATENT DOCUMENTS

| | | | |
|---|---|---|---|
| 2,184,269 | 12/1939 | Brown et al. . | |
| 2,268,700 | 1/1942 | Criger et al. | 313/318.03 |
| 2,336,529 | 8/1942 | Cartun . | |
| 2,429,287 | 10/1947 | McGowan et al. . | |
| 2,664,551 | 8/1951 | Kuebler . | |
| 2,732,532 | 12/1953 | Tamis . | |
| 2,736,873 | 2/1956 | Bechard et al. . | |
| 3,619,876 | 11/1969 | Besacier . | |
| 3,629,640 | 12/1971 | Audesse et al. | 313/318 |
| 3,775,463 | 11/1973 | Hasell et al. | 313/318 |
| 4,044,277 | 8/1977 | Komyati | 313/318 |
| 4,654,557 | 3/1987 | Haraden | 313/318.03 |
| 4,658,178 | 4/1987 | Bradley et al. | 313/113 |
| 5,126,634 | 6/1992 | Johnson | 315/71 |

FOREIGN PATENT DOCUMENTS

| | | |
|---|---|---|
| 466897 | 9/1928 | Germany . |
| 5419348 | 8/1980 | Japan . |
| 5853655 | 4/1983 | Japan . |
| 444958 | 3/1936 | United Kingdom . |

*Primary Examiner*—Nimeshkumar D. Patel
*Attorney, Agent, or Firm*—Brian J. Wieghaus

[57] ABSTRACT

An electric lamp includes a lamp cap having an insulative body of synthetic material with a bore therein. A lamp cap contact includes a rigid shank received in the bore of the insulative body. The diameters of the bore and shank and the elasticity of the bore wall are selected so that a conductive lead of the lamp is securely clamped between the shank and the bore wall when the shank is fully received in the bore. In a favorable embodiment, the lead has a free end extending in the direction of insertion of the shank into the bore, which avoids the lead wire from being pushed out of the bore.

19 Claims, 4 Drawing Sheets

ELECTRIC LAMP HAVING A LAMP CAP WITH SOLDER-FREE CONNECTIONS

BACKGROUND OF THE INVENTION

The invention relates to an electric lamp comprising:

a lamp envelope, a light source within the lamp envelope which is energizeable for emitting light, an electrically conductive lead extending from the light source within the lamp envelope to the exterior of the envelope, and a lamp cap having (i) an electrically insulative portion and (ii) a lamp cap contact to which the electrically conductive lead is clamped.

Numerous examples of lamps with lamp caps having a contact which clampingly receives a conductive lead are present in the art.

A first group of lamp caps in the prior art discloses a generally planar disk-shaped end contact with various flaps or protrusions to mechanically secure the lead wire. U.S. Pat. No. 2,664,551 shows a lamp cap in which the end contact has a tubular metal extension with four quadrants or flaps. The lead is secured to the tubular extension by folding the four flaps over each other, trapping the center lead wire therebetween. This construction has the disadvantage of a complex shape and a complex assembly with numerous steps. The end cap first must be secured in the insulative material, and then each of the four distinct flaps folded over each other to trap the lead therebetween. Additionally, the folded flaps present a different, if not unfinished, appearance from the smooth, button-shaped appearance provided by traditional soldering techniques. In U.S. Pat. No. 2,736,873, the protrusion is a dome-shaped boss with an aperture through which the lead wire is threaded. The lead is secured in the aperture by swaging the wire and boss with the aid of a rotating die to flatten the end of the wire against the boss and to roll the rim of the aperture against the opposite side to clamp the lead therebetween. JP 58-53655 shows another modification in which the disc shaped end cap has a single flap which is bent over, trapping the lead between opposing edges of the flap and the aperture defined by the flap. The bent over flap does not itself provide sufficient electrical and mechanical contact, as the lead wire is additionally welded to the flap. U.S. Pat. No. 2,732,532 shows yet another construction in which the protrusion in the disc-shaped end contact is in the form of four circumferentially spaced inwardly extending lips. DD PS 221.299 shows still another variation in which the protrusion is a slotted tube which is clamped about the lead wire and cut to length together with the lead wire. The lead wire is then also welded to the tube. Besides the rather complex and costly flap constructions presented by some of the above designs, they have in common that they require at least two assembly steps: the disk must first be secured in the insulative body, and then the protruding flaps, lips etc. must then be mechanically deformed by a tool to trap the lead wire.

U.S. Pat. Nos. 3,629,640 and 3,775,634 show another type of lamp cap construction in which the lead wire is clamped between a protruding boss of the insulative body and a metallic end cap which forms the center contact. In the '634 patent, the insulator body is of a fast firing glass-ceramic body and the end cap is secured to the boss by a force fit, glue or solder. For a force fit, the cap has a tubular portion with an inner diameter slightly smaller than that of the combined diameter of the boss and the lead wire. This construction would require tight tolerances on the inner diameter of the cap because of the rigid nature of the glass-ceramic body and the un-slotted construction of the tubular portion of the metallic end cap, which requires local deformation of the tubular portion about the lead wire to obtain a suitable force fit. In the '640 Patent, the insulator body is glass and the boss has a tapered or profiled shape. The metal end cap must be mechanically worked to deform it onto the tapered or profiled edge of the boss.

U.S. Pat. No. 2,336,529 shows another design in which the lead wire is fixed within a central bore of the insulative body by a metallic plug with "snap action". The plug has a planar disk-shaped portion and a generally cylindrical portion which is split into a plurality of spring-like locking fingers. The fingers have bevelled edges at their free ends for snapping over the shoulder of the insulator body. The spring-like fingers are relatively complicated, rendering the contact plug comparatively expensive to manufacture. Additionally, the plug is only secured to the insulator body by the force exertable by the elongate fingers, so movement of the plug and intermittent electrical contact with the end plug, with resultant arcing, would be expected. The '529 patent also shows an embodiment in which the center contact is a tubular rivet with a flat outer head. Once the lead is passed through the center bore, the rivet is inserted into this bore with the wire between the insulator body and the rivet. The free end of the rivet inside the insulator body is then deformed by an undisclosed tool inserted through the tubular portion from the head end. As with the disc-shaped contacts first discussed, the extra step of mechanically deforming the contact is required, as is trimming of the excess lead wire.

The above-mentioned designs generally concern the fixation of the center lead wire to the center contact. Various forms of clamping are also known in the prior art for the side lead wire. The above-mentioned '529 patent discloses an embodiment in which the insulator body is secured in the threaded shell by rolling of the shell or a snap-fit action with the shell. The side lead wire is secured between the insulator body and the threaded shell. The wire extends in the direction of the shell and the excess wire needs to be trimmed-off. Additionally, it is known from commercially available compact fluorescent lamps to fix the side lead-wire between the threaded metallic shell of the lamp cap and the plastic housing by swaging, pinning, or otherwise deforming the threaded shell onto the plastic housing with the side lead wire therebetween.

Despite the numerous known configurations for lamp caps with a mechanically fixed lead wire, lamp caps in which one or both lead wires is soldered or welded to a metal portion of the shell still predominate on commercially available lamps with threaded lamp caps, such as Edison bases. The solders which have been widely used in the industry contain lead. In addition to its increased expense in recent years, it is desirable to avoid the use of lead-containing materials. Additionally, welding is not always a viable alternative because of the difficulty in achieving reliable contact of both welding electrodes with many lamp cap configurations.

Accordingly, it is the object of the invention to overcome the above-mentioned disadvantages of the prior art lamp caps and to otherwise provide an electric lamp with an improved, solder-free and weld-free construction.

SUMMARY OF THE INVENTION

The above objects are accomplished in that a lamp of the type described in the opening paragraph is characterized in that:

the lamp cap contact comprises (i) a contact portion for contacting a corresponding contact in a socket and (ii) a rigid shank extending from the contact portion; and the insulative portion has a bore wall defining a clamping bore for receiving the shank, the bore being sized and the insulative portion surrounding said clamping bore having an elasticity selected such that (i) the electric lead is securely clamped between the shank and the bore wall when the shank is inserted into the clamping bore with the contact portion seated against the insulative portion and (ii) the lamp contact is secured in the clamping bore solely by friction between the shank and the bore wall, the shank and the bore wall being free of any snap-type engagements.

The above features provide a simple, readily manufacturable lamp cap construction in which a simple insertion of the contact's shank into the clamping bore (i) firmly secures the lamp contact in the lamp cap and (ii) provides a reliable electrical connection of the lead to the contact and mechanical connection of the lead to the lamp cap. The contact itself is simple—there are no bendable leaves, tabs, lips, flaps or fingers. Accordingly, no closing of these elements is required as with the prior art lamp caps. No additional welding, peening, pinning, swaging or other metal forming of this contact is required either. The simple shape of the contact and the simple axial insertion motion of the contact into the bore implies a rather simple mechanization, which is extremely important for the very high speed manufacturing necessary for a commercially successful lamp production.

According to a favorable embodiment, the lead extends into the clamping bore with its free end extending in the direction of insertion of the shank into the clamping bore. This avoids the possibility of the lead being pushed out of the bore back towards the lamp envelope when the shank is inserted in the clamping bore. This also has the significant advantage that since the free end of the lead is extending into the bore in the direction of the envelope that the lead does not extend to the exterior of the lamp cap. Thus, no trimming of the lead is necessary, further simplifying production.

The above-described orientation of the lead is carried out in one embodiment by a guide bore in the insulative portion which axially extends adjacent the clamping bore. The lead extends from the lamp envelope through the guide bore in the direction opposite the direction of insertion of the shank and then extends into the clamping bore, providing a simple threading path. Favorably, the guide bore includes tapered guide walls narrowing in the direction away from the lamp envelope for guiding the lead into and through the guide bore as the lamp cap is placed onto the lamp envelope to receive the lead. Thus, less criticality is required in aligning the lamp caps with the envelope to reliably thread the lead during high speed production.

To provide a neat, tamper-proof appearance it is desirable that the guide bore terminates adjacent the clamping bore so that the guide bore and the lead extending therefrom into the clamping bore are fully covered by the contact portion of the lamp cap contact. To further improve appearance and tamper resistance, in another embodiment the insulative portion includes a counter bore having a shape complimentary to the contact portion and into which the contact portion is recessed. Recessing the circumferential outer edge of the contact in this manner renders it very difficult for a user to remove the contact without tools.

Instead of the guide bore extending axially adjacent the clamping bore for guiding the lead to the exterior, the guide bore may communicate directly with the clamping bore and guide the lead directly into the clamping bore, for example, at right angles to its axis. This has the advantage that the clamping bore itself acts as a stop to limit the exposure of the lead, thereby automatically measuring the length of the lead to be clamped in the bore.

In yet another embodiment, suitable for lamps which use leads having a conductive core covered by an insulative sheath, such as the leads extending from a ballast within integral compact fluorescent lamps, the guide bore itself includes a stop which engages the sheath but not the core to control the length of the core inserted into the clamping bore. This feature also prevents the possibility of the lead from being pulled further into the bore during insertion of the shank.

The above features are also applicable to other embodiments of the lamp cap which include another lead clamped by an additional lamp cap contact, such as a threaded shell which is placed over the insulative portion or which receives the insulative portion.

These and other features of the invention will be described with reference to the following drawings and detailed description, which are illustrative of the inventive features and not limiting.

DESCRIPTION OF THE PREFERRED EMBODIMENTS

Figure 1:
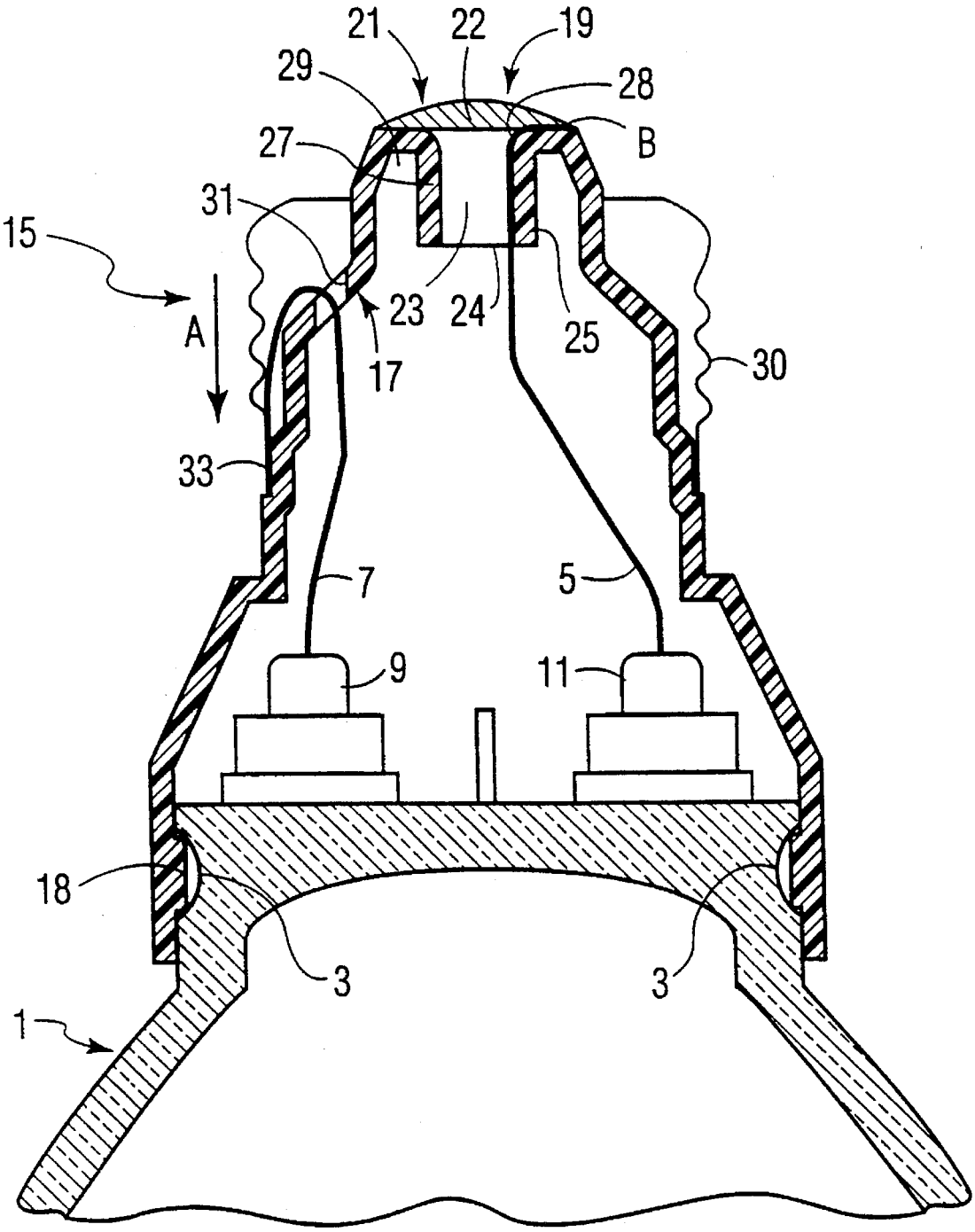
FIG. 1 is a cross-section of a PAR lamp illustrating a first embodiment of a lamp cap according to the invention.

FIG. 1 shows an end portion of the reflector body of a parabolic aluminized reflector (PAR) lamp including a lamp cap which embodies several features of the invention. As the light source construction (filament; halogen burner) for these lamps is well known and unnecessary for an understanding of the present invention, it has been omitted from the drawings for purposes of clarity.

The lamp includes a lamp envelope 1 of hard glass having a plurality of recesses 3. A conductive center lead wire 5 and a corresponding side wire 7 extend from respective ones of ferrules 9, 11 in the axial direction away from the lamp envelope 1. The ferrules 9, 11 hermetically seal the envelope 1 and provide mechanical support and electrical connection to the light source (not shown) in a well known manner. The lamp cap 15 has an electrically insulative portion 17 of synthetic resin material and an electrically conductive lamp cap contact 19. The contact 19 has (i) a contact portion 21 for contacting a corresponding contact in a mating socket and (ii) a rigid shank 23 extending from the contact portion 21.

The insulative portion 17 is a shell which is fixed to envelope 1 by a snap-fit connection between lugs 18 and recesses 3. The insulative portion 17 has a re-entrant portion 25 with a bore wall 27 defining a clamping bore for receiving the shank 23. The bore wall 27 has a diameter selected relative to that of shank 23 and the synthetic resin material of the insulative portion has a modulus of elasticity selected so that the center lead 5 is securely clamped between the shank 23 and the bore wall 27 when the shank is inserted into the clamping bore with the underside 22 of the contact portion 21 seated against the end surface 29 of the reentrant portion 25. The lamp contact 19 and lead wire 5 are secured in the clamping bore solely by the press fit between the shank 23 and the bore wall 27 due to the elasticity of the synthetic resin material of the bore wall.

In the lamp cap of FIG. 1, the shank 23 and the bore wall 27 are both circular-cylindrical in shape. The shank 23 has a rounded/chamfered edge 24 as does bore wall 27 (at reference numeral 28) to guide the shank during insertion into the clamping bore. Alternatively, the shank/bore may have a slight taper, for example on the order of 1°–2° towards the lamp envelope. The shank 23 as shown is solid, but may be tubular. The simplicity of these shapes allow these elements to be more cheaply manufactured than some of the more complicated components present in the prior art, such as with the spring-fingers of the contact shown in U.S. Pat. No. 2,336,529 or the quadrant flaps of U.S. Pat. No. 2,664,551. Additionally, the insertion of the contact into the clamping bore in the present invention completes the assembly, whereas the tubular rivet of the '529 patent and the flaps, tabs, lips or leaves of the other discussed patents require further mechanical deformation to clamp the wire after their contacts are first secured to their respective insulative bodies. Accordingly, it is readily seen that the disclosed arrangement according to the invention is a simple, elegant, yet effective solution which has previously remained unrecognized by those in the lamp arts.

The lamp cap 15 of FIG. 1 further includes a threaded metallic contact 30, which is in electrical contact with the side lead wire 7. The side lead wire extends from ferrule 9 through bore 31 and then back towards the envelope 3 in the direction of insertion (indicated by Arrow A) of the threaded contact 30. The threaded shell 30 is circumferentially swaged or peened to the shell 17 at the axial location indicated by reference numeral 33 to mechanically secure it to the synthetic shell 17 and to provide electrical contact with side wire 7.

Figure 2:
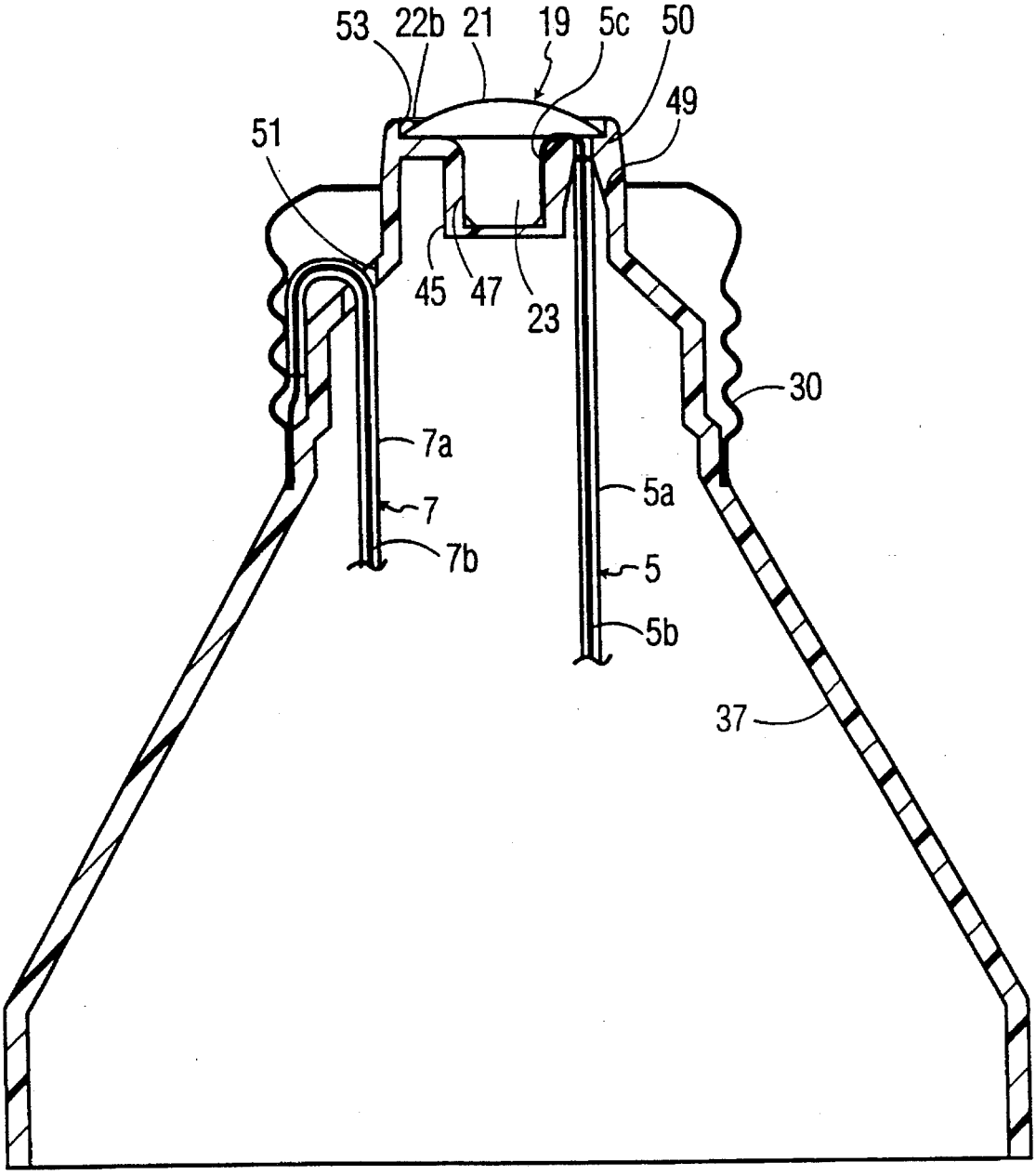
FIG. 2 is a cross-section of the shell portion of a compact fluorescent lamp illustrating a second embodiment with a variation of the threading path of the center lead wire from that shown in FIG. 1.

FIG. 2 illustrates a lamp cap for a compact fluorescent lamp. Parts identical to those in FIG. 1 bear the same reference numerals. The threaded metal shell 30 and the side lead wire 7 are connected to the synthetic shell 37 in the same manner as to shell 17 in FIG. 1. The shell 37 forms a housing which is suitable for enclosing a ballast and for holding a low pressure mercury vapor arc tube at its end remote from the contact 19. The leads 5, 7 in this embodiment have an insulative sheath **5*a*, 7*a* about their conductive single-strand core 5*b*, 7*b* respectively. The shell 37 has tapered guide walls 49 for guiding the lead 5*a* through the guide bore 50. The guide walls 49 also serve as a stop for limiting the length of the trimmed end portion 5*c* (stripped of its insulative sheath) which extends out of the guide bore 50 by engaging the end of the insulative sheath. The trimmed end portion 5*c* is clamped between shank 23 and the bore wall 47 of the re-entrant portion 45 in the same manner as in FIG. 1. However, since the free end portion 5*c* extends in the same direction as the direction of insertion of the shank into the clamping bore, (indicated by arrow "c"), the free end portion cannot be pushed out of the bore during insertion of the shank 23. Movement of the lead wire 5 is further limited by the interaction of the end of the sheath 5*a*** with the tapered guide walls.

The shell 37 also has a recess 53 which as a complementary shape to the outer circumferential edge **22*b* of contact 19. Recessing of this edge prevents tampering by the user to remove contact 19. The guide bore 50 and lead 5 are also covered by the contact portion 21 of contact 19, providing a neat, clean appearance. Since end portion 5*c* extends into the guide bore in the direction of insertion of shank 23, it need not be trimmed as is the case with the excess shown in FIG. 1** with dashed lines.

Figure 3:
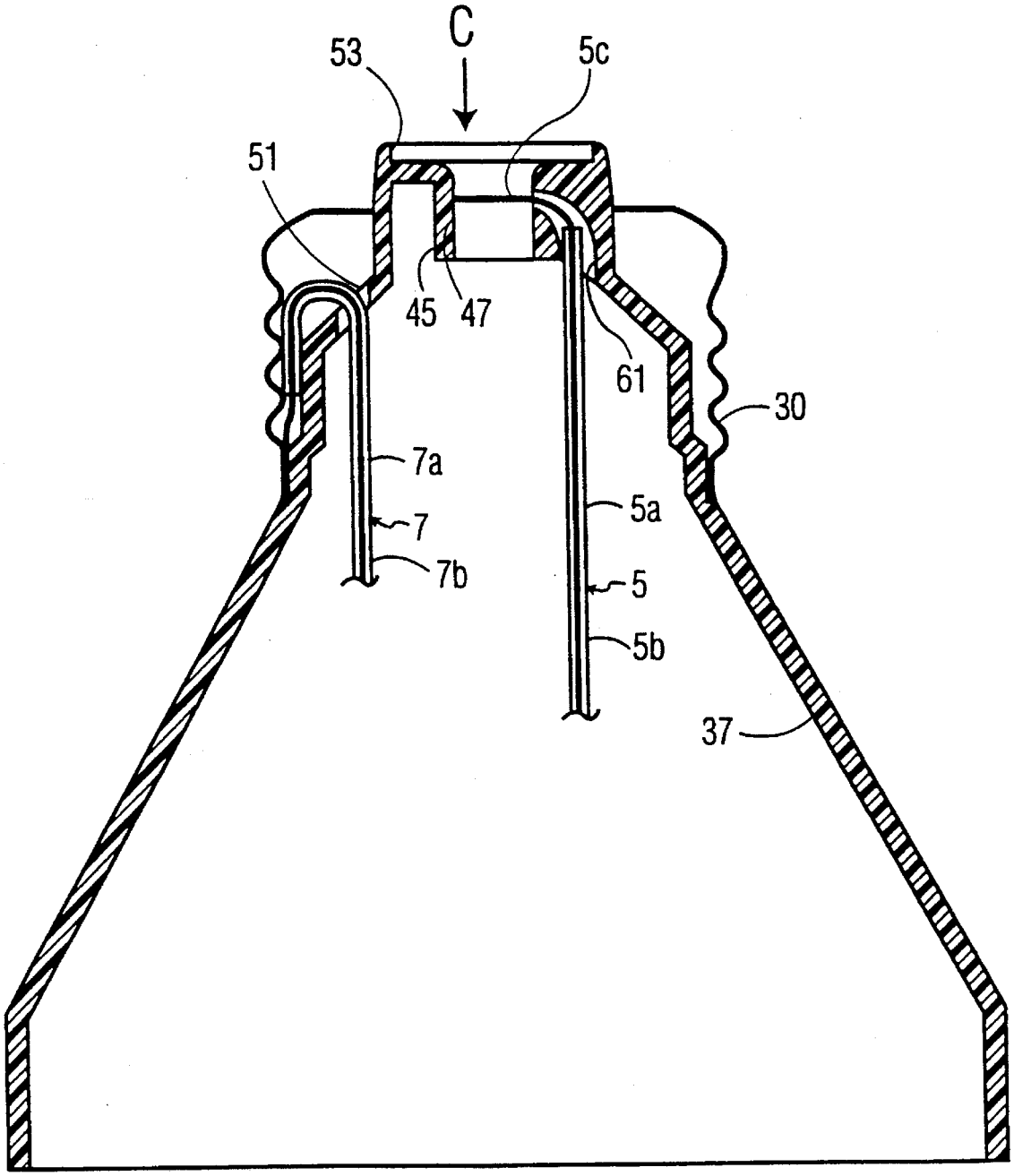
FIG. 3 is a cross section of a third embodiment illustrating another threading path for the center lead-wire.

FIG. 3 shows a construction similar to that in FIG. 2 but in which the guide bore 61 communicates directly with the clamping bore, extending generally transversely to the direction of insertion (identified by arrow "c") of shank 23. The length of the free end portion **5*c* is limited by the opposing face of the bore wall 47, opposite that through which the guide bore extends. The contact 19 is not shown, to better illustrate the position of end portion 5*c* after threading through the guide bore 61. Upon insertion of shank 23 into the clamping bore, the end portion 5*c* will deflect downward and be clamped between bore wall 47 and shank 23. Since the guide bore 61 enters directly into the clamping bore, the lead 5*c*** never extends to the outside and does not need to be trimmed.

Figure 4:
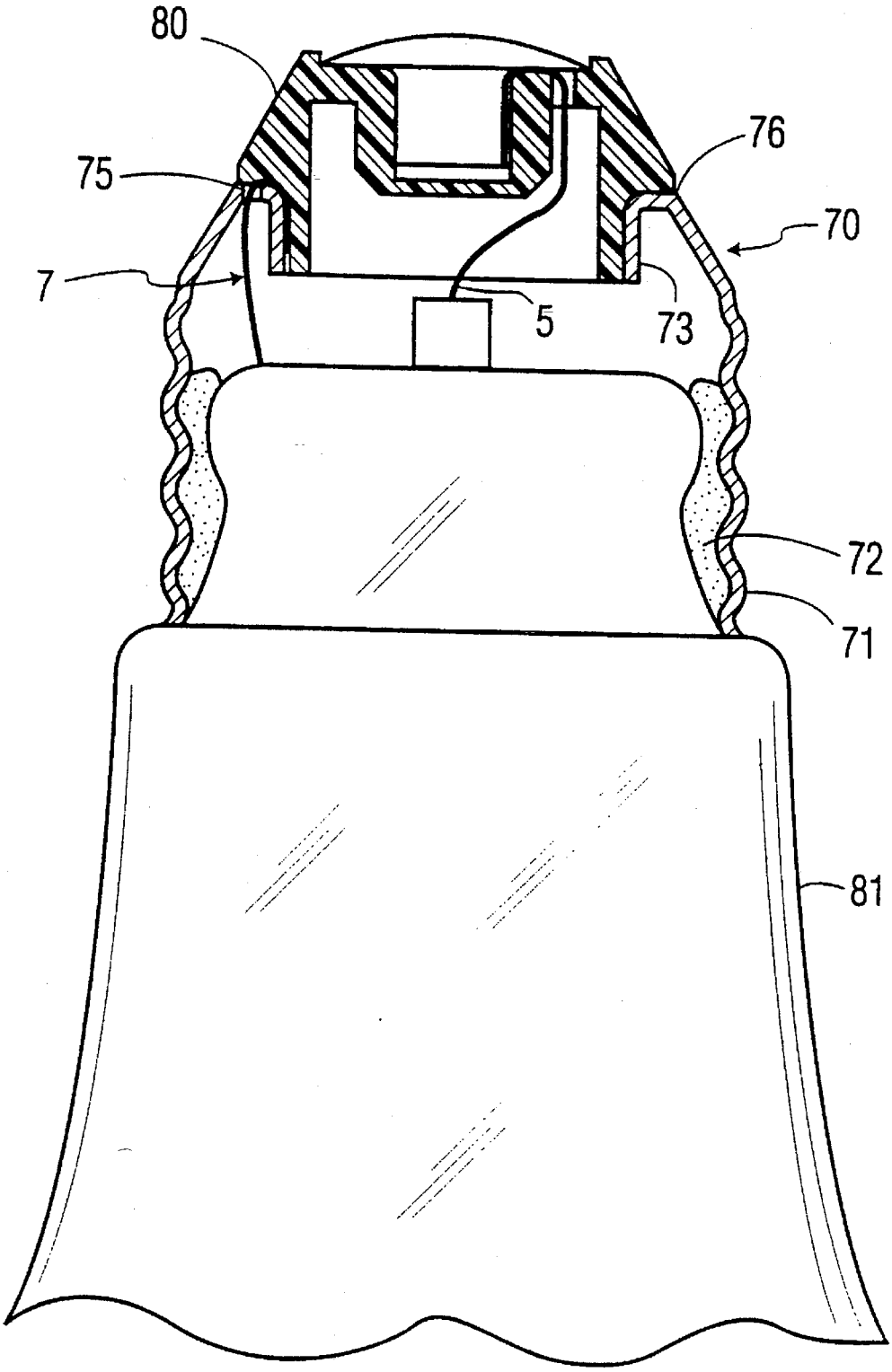
FIG. 4 is a cross-section of an incandescent lamp illustrating further features of the invention.

FIG. 4 illustrates another embodiment of the invention which is suitable for incandescent lamps. Reference numeral 81 denotes a sealed end portion of a standard A-type incandescent lamp envelope. The lamp cap 70 has a metallic threaded shell portion 71 which is secured to the envelope 61 with cement 72 in a manner standard in the industry and serves as one of the lamp cap contacts. Shell portion 71 has a reentrant portion 73 which receives insulative portion 80 with a snap-fit, or alternatively, a press fit connection. The side lead 7 extends through a bore 75, located at a U-shaped rim portion 76, initially in the direction away from the envelope 81 and then back towards envelope 81 along the face of reentrant portion 73. When insulative insert 80 is snap-fit into reentrant portion 73, the side lead 7 is clamped therebetween providing both mechanical fixation and electrical connection. Since the free end of side lead 7 extends towards the lap envelope, i.e., in the direction of insertion of the insulative body 80 into reentrant portion 73, there is no danger of the free end portion being pushed back toward the lamp envelope. The contact 19 is received in the insulative body and the center lead 5 is clamped therebetween in the same manner as described with respect to FIG. 3.

In the embodiments shown above, suitable materials for the center contact 19 include brass and aluminum. A suitable material for the insulative body 80 in the incandescent lamp of FIG. 4 is FIBERITE,™ available from the ICI company. Suitable materials for the shell 37 of the CFL lamps of FIGS. 2 and 3 include polycarbonate and PBT. The shell 17 of the embodiment of FIG. 1 may be made of polycarbonate and PBT, as well as of polyethermide, polysulphine, polyphenlsulphine, and FIBERITE. The lead wires for the embodiment of FIG. 1 (PAR lamp) were of 0.030"/0.025" nickel solid wire. The lead wires for the embodiments of FIGS. 2,3 (CFL) had one (1) tinned copper strand with a PVC/nylon insulation sheath. Suitable lead wires for the embodiment of FIG. 4 are standard leads used for incandescent lamps bases, such as 14 EV41, 18CU49, or 14HCU50, to name a few. The feasibility of the design has been demonstrated in CFL lamps with a plastic shell and eyelet (un-recessed as for the PAR lamp in FIG. 1) which have burned for over 10,000 hours, base-up, in a high-hat fixture without failure.

The above-described embodiments illustrate various features; each of which may be used with various combinations of the others and for different lamp types and lamp cap configurations other than that shown. Those or ordinary skill in the art will appreciate that various modifications can be made which are still within the scope of the appended claims. Accordingly, the above embodiments should be considered to be illustrative only, and not limiting.

I claim:

1. An electric lamp comprising a lamp envelope, a light source within said lamp envelope which is energizeable for emitting light, a conductive lead extending from said light source within said lamp envelope to the exterior of said envelope, and a lamp cap having an electrically insulative portion and a lamp cap contact, said lead being clamped between said lamp contact and said electrically insulative portion, characterized in that:

said lamp cap contact comprises (i) a contact portion for contacting a corresponding contact in a socket and (ii) a rigid shank extending from said contact portion; and said insulative portion having a bore wall defining a clamping bore for receiving said shank, said bore being sized and said insulative portion surrounding said clamping bore having an elasticity selected such that (i) said first electric lead is securely clamped between said shank and said bore wall when said shank is inserted into said clamping bore with said contact portion seated against said insulative portion and (ii) said lamp contact is secured in said clamping bore solely by friction between said shank and said bore wall, said shank and bore being free of any snap-type engagements.

2. An electric lamp according to claim 1, characterized in that said lead extends into said clamping bore with the end of said first lead extending in the direction of insertion of said shank into said clamping bore.

3. An electric lamp according to claim 2, characterized in that said insulative portion comprises a guide bore extending adjacent said clamping bore, said lead extending from said lamp envelope through said guide bore in the direction opposite the direction of insertion of said shank and then into said clamping bore receiving said shank.

4. An electric lamp according to claim 3, wherein said guide bore includes tapered guide walls narrowing in the direction away from said lamp envelope for guiding said lead into said guide bore.

5. An electric lamp according to claim 4, wherein said guide bore terminates adjacent said clamping bore such that said guide bore and said lead extending therefrom into said clamping bore are fully covered by said contact portion of said lamp cap contact.

6. An electric lamp cap according to claim 5, wherein said insulative portion includes a counter bore having a shape complimentary to said contact portion and into which said contact portion is recessed.

7. An electric lamp according to claim 3, wherein said guide bore terminates adjacent said clamping bore such that said guide bore and said lead extending therefrom into said clamping bore are fully covered by said contact portion of said lamp cap contact.

8. An electric lamp according to claim 7, wherein said insulative portion includes a counter bore having a shape complimentary to said contact portion and into which said contact portion is recessed.

9. An electric lamp according to claim 3, wherein said guide bore communicates with said clamping bore.

10. An electric lamp according to claim 9, wherein said insulative portion includes a counter bore having a shape complimentary to said contact portion and into which said contact portion is recessed.

11. An electric lamp cap according to claim 2, wherein said insulative portion includes a counter bore having a shape complimentary to said contact portion and into which said contact portion is recessed.

12. An electric lamp according to claim 1, wherein said insulative portion includes a counter bore having a shape complimentary to said contact portion and into which said contact portion is recessed.

13. An electric lamp according to claim 1, further comprising a conductive shell portion defining a second lamp cap contact, said insulative portion of synthetic material being fixed in said shell portion, and said lamp including an additional conductive lead extending from said light source and including a portion clamped between said insulative portion and said shell portion.

14. An electric lamp according to claim 13, wherein said portion clamped between said insulative portion and said shell portion is a free end portion of said lead extending in the direction of insertion of said shank.

15. An electric lamp according to claim 14, wherein said conductive shell portion comprises a reentrant portion for receiving said insulative portion, said reentrant portion comprising means for securing said insulative portion with a snap fit.

16. An electric lamp according to claim 1, wherein said insulative portion is a shell secured to said lamp envelope, said lamp cap further comprising a second conductive contact secured to said shell, and said lamp comprising an additional conductive lead extending from said light source and having a portion clamped between said second conductive contact and said shell.

17. An electric lamp according to claim 16, wherein said second conductive contact circumferentially surrounds a portion of said shell and is mateable onto said shell in the direction of insertion of said shank, said portion of said additional lead clamped between said shell and said second contact being a free end portion of said lead extending in the direction of insertion of said shank.

18. An electric lamp according to claim 17, wherein said shell includes an opening through which said additional lead extends in the direction away from said lamp envelope.

19. An electric lamp, comprising:

a) a lamp envelope;

b) a light source within said lamp envelope which is energizable for emitting light;

c) a conductive lead extending from the light source to the exterior of the lamp envelope; and d) a lamp cap having an electrically insulative portion with a bore wall defining a bore therein and a lamp cap contact received in said bore which clamps a free end portion of said lead between said contact and said bore wall, said lamp cap including a guide wall for guiding said lead into said clamping bore, said lead extending along said guide wall in the direction opposite the direction of insertion of said lamp cap contact into said clamping bore, and said free end portion of said lead extending in said bore in the direction of insertion of said contact into said bore.

* * * * *